US010469939B1

(12) United States Patent
Tikander et al.

(10) Patent No.: US 10,469,939 B1
(45) Date of Patent: Nov. 5, 2019

(54) HEADPHONES WITH TUNABLE DAMPENING FEATURES

(71) Applicant: Apple Inc., Cupertino, CA (US)

(72) Inventors: Miikka O. Tikander, Sunnyvale, CA (US); Timon A. Wright, San Francisco, CA (US); Esge B. Andersen, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/126,333

(22) Filed: Sep. 10, 2018

Related U.S. Application Data

(60) Provisional application No. 62/565,491, filed on Sep. 29, 2017.

(51) Int. Cl.
*H04R 1/28* (2006.01)
*H04R 1/10* (2006.01)
*H04R 5/033* (2006.01)

(52) U.S. Cl.
CPC ..... *H04R 1/2811* (2013.01); *H04R 1/1008* (2013.01); *H04R 1/288* (2013.01); *H04R 1/2888* (2013.01); *H04R 5/0335* (2013.01)

(58) Field of Classification Search
CPC .. H04R 1/1008; H04R 5/0335; H04R 1/2888; H04R 1/288; H04R 1/2811
See application file for complete search history.

(56) References Cited

U.S. PATENT DOCUMENTS

| | | | | |
|---|---|---|---|---|
| 8,447,058 | B1 | 5/2013 | Sung et al. | |
| 8,467,539 | B2 | 6/2013 | Sapiejewski et al. | |
| 9,438,980 | B2 | 9/2016 | Huang et al. | |
| 2015/0050436 | A1* | 2/2015 | Sereboff | G10K 11/165 428/34.1 |
| 2016/0119460 | A1* | 4/2016 | Shi | H04M 1/035 455/570 |
| 2017/0208387 | A1 | 7/2017 | Bearden | |

FOREIGN PATENT DOCUMENTS

| | | |
|---|---|---|
| CN | 105516842 | 4/2016 |

* cited by examiner

*Primary Examiner* — Regina N Holder
(74) *Attorney, Agent, or Firm* — Kilpatrick Townsend & Stockton LLP

(57) ABSTRACT

Headphones are disclosed that include a first earcup assembly. The first earcup assembly includes a first speaker and a plurality of tunable acoustic dampeners at least partially surrounding the first speaker. The plurality of acoustic dampeners are configured to dampen standing wave resonances. The headphones include a second earcup assembly and a headband extending between the first and second earcup assemblies. The headband includes first and second opposing ends attached to the first and second earcup assemblies, respectively.

23 Claims, 11 Drawing Sheets

HEADPHONES WITH TUNABLE DAMPENING FEATURES

CROSS-REFERENCES TO RELATED APPLICATIONS

The present application claims the benefit of and priority to U.S. Provisional Application No. 62/565,491, filed Sep. 29, 2017, the entire contents of which are incorporated herein by reference for all purposes. This application is related to co-assigned and concurrently filed U.S. application Ser. No. 16/126,290, entitled "HEADPHONES WITH ACOUSTICALLY SPLIT CUSHIONS", which claims the benefit of and priority to U.S. Provisional Application No. 62/565,458, filed Sep. 29, 2017, the full disclosures of which are incorporated by reference herein in their entireties for all purposes.

FIELD

The described embodiments relate generally to various headphone dampening features. More particularly, the described embodiments relate to headphones having a plurality of tunable dampeners positioned in a front volume thereof.

BACKGROUND

Over-ear or circumaural headphones have been in use for many years. Over-ear headphones typically include a headband and a pair of earcups attached to opposing ends of the headband which completely encircle or surround a user's ears when worn. Over-ear headphones can include earcups of a closed-back or open-back design. Closed-back earcups have acoustically sealed or substantially-sealed backs. Open-back earcups have backs acoustically open to ambient environment and noise surrounding the earcups. While closed-back earcups have backs which are acoustically sealed to the ambient environment and noise, the earcups can include one or more vents configured to provide barometric pressure relief.

Over-ear headphones with closed-back earcups typically provide good sound isolation because they are sealed or substantially sealed off from ambient noise. However, they can also have certain disadvantages due to the closed design of the earcups. In some closed-back headphones, undesirable or unwanted resonances (e.g., modes) may develop inside a front volume of each respective earcup (e.g., air volume encapsulated inside the earcup or between the earcup and a wearer's skull and/or ear). Further, standing waves can accumulate in the earcups (e.g., between a driver housing plate of the earcup and a wearer's skull and/or ear) which can degrade sound quality considerably. Typically, these standing waves can occur in the 7-9 kHz range which can lead to undesirable or unwanted resonance in a frequency response of the headphones. As resonance frequency varies between wearers or users (e.g., due to anatomical differences), such unwanted standing wave resonance may be difficult to equalize with, for example, a digital signal processor (DSP) or graphic equalizer (EQ). As such, there remains a need for headphones with improved dampening features, and in particular, passive acoustic dampeners for closed-back, over-ear headphones.

BRIEF SUMMARY

The present disclosure describes several improvements related to circumaural headphone designs including designs that have improved passive dampening features that are particularly useful for closed-back over-ear headphones. In some embodiments improved dampening is provided by a plurality of acoustic dampeners disposed in each earcup around a periphery of the earcup speaker. The acoustic dampeners can reduce standing waves (e.g., in about the 7-9 kHz range) that can sometimes develop inside the front volume of a closed-back earcup between a driver housing plate and a user's skull as a result of the sound isolating design of the earcup. In various embodiments the acoustic dampeners can include resonators tuned to dampen resonance frequencies of standing waves and/or include a sound absorbing material having acoustic properties that absorb such standing wave frequencies as the waves move or are reflect through the sound absorbing material.

Headphones are disclosed that include a first earcup assembly. The first earcup assembly includes a first speaker and a plurality of tunable acoustic dampeners at least partially surrounding the first speaker. The plurality of acoustic dampeners are configured to dampen standing wave resonances. The headphones include a second earcup assembly and a headband extending between the first and second earcup assemblies. The headband includes first and second opposing ends attached to the first and second earcup assemblies, respectively. In some embodiments, the second earcup assembly is configured similarly to the first earcup assembly. For example, the second earcup assembly can include a second speaker and a plurality of tunable acoustic dampeners encircling a periphery of the second speaker.

In some embodiments, the first earcup assembly includes a front volume housing extending along a back side of the plurality of tunable acoustic dampeners. The plurality of tunable acoustic dampeners may include a plurality of chambers bounded by the front volume housing and a solid film layer having a plurality of openings corresponding to the plurality of chambers formed, wherein each opening in the plurality of openings is arranged to allow standing waves to enter one of the plurality of chambers. In some embodiments, each of the plurality of chambers and its corresponding opening is configured such that standing waves enter the chamber in a first direction and travel therethrough in a second direction, the second direction being non-parallel to the first direction. For example, each of the plurality of chambers and its corresponding opening may be configured such that the standing waves travel along a substantially L-shaped path through the plurality of chambers. In some embodiments, the plurality of chambers includes a plurality of sidewalls extending substantially transverse to the front side of the solid film layer. In some embodiments, the plurality of chambers includes an acoustic dampening material positioned with each chamber.

In some embodiments, the first earcup assembly includes a front volume housing and the plurality of tunable acoustic dampeners includes a plurality of perforations in the front volume housing. A back side of the plurality of perforations may be acoustically sealed by a back plate. In some embodiments, opposing ends of each perforation of the plurality of perforations are substantially flush with front and back sides of the front volume housing. In some embodiments, the first earcup assembly includes an acoustic dampening material extending along a front side of the front volume housing. The first earcup assembly may include an acoustic dampening material extending along a back side of the front volume housing. In some embodiments, the plurality of tunable acoustic dampeners includes an acoustic dampening material positioned within each perforation. The plurality of tunable acoustic dampeners may be tuned to dampen standing waves in a frequency range of 7 to 9 kHz.

In some embodiments, the plurality of tunable acoustic dampeners is tuned to dampen standing waves of a same frequency. In certain embodiments, a first tunable acoustic dampener of the plurality of tunable acoustic dampeners is tuned to dampen a standing wave of a first frequency and a second tunable acoustic dampener of the plurality of tunable acoustic dampeners is tuned to dampen a standing wave of a second frequency. The first frequency may be different from the second frequency.

In some embodiments, the plurality of tunable acoustic dampeners may include a plurality of acoustic resonators. The plurality of acoustic resonators may include a plurality of Helmholtz resonators. In some embodiments, the first earcup assembly includes a front volume housing and wherein the front volume housing includes at least one of a speaker grill and speaker module. The second earcup assembly may include a second speaker and a plurality of tunable acoustic dampeners at least partially surrounding the second speaker, the plurality of acoustic dampeners being configured to dampen standing wave resonances. The plurality of tunable acoustic dampeners may encircle a periphery of the first speaker. In some embodiments, the plurality of tunable acoustic dampeners encircle a periphery of the second speaker.

Other aspects and advantages of the invention will become apparent from the following detailed description taken in conjunction with the accompanying drawings which illustrate, by way of example, the principles of the described embodiments.

DETAILED DESCRIPTION

The present disclosure describes various embodiments of headphones with improved tunable dampeners and associated methods of dampening standing wave resonances in a front volume of closed-back, over-ear or circumaural headphones.

Certain details are set forth in the following description and in FIGS. 1-10B to provide a thorough understanding of various embodiments of the present disclosure. Other details describing well-known structures and systems often associated with headphones, headphone components, earcup assemblies, speakers, etc., however, are not set forth below to avoid unnecessarily obscuring the description of the various embodiments of the present disclosure.

Many of the details, dimensions, angles and other features shown in FIGS. 1-10B are merely illustrative of particular embodiments of the present disclosure. Accordingly, other embodiments can include other details, dimensions, angles and features without departing from the spirit or scope of the present disclosure. In addition, those of ordinary skill in the art will appreciate that further embodiments of systems described herein can be practiced without several of the details described below. Various embodiments of the present disclosure can also include structures other than those illustrated in the Figures and are expressly not limited to the structures shown in the Figures. Moreover, the various elements and features illustrated in the Figures may not be drawn to scale. In the Figures, identical reference numbers identify identical or at least generally similar elements.

Figure 1A:
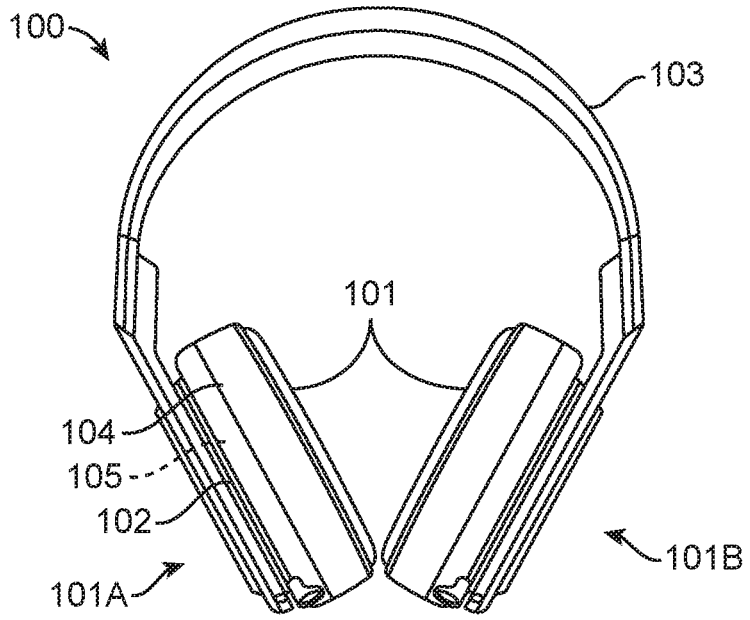
FIG. 1A shows an over-ear headphone with closed-back earcup assemblies configured in accordance with an embodiment of the present disclosure.
Figure 1B:
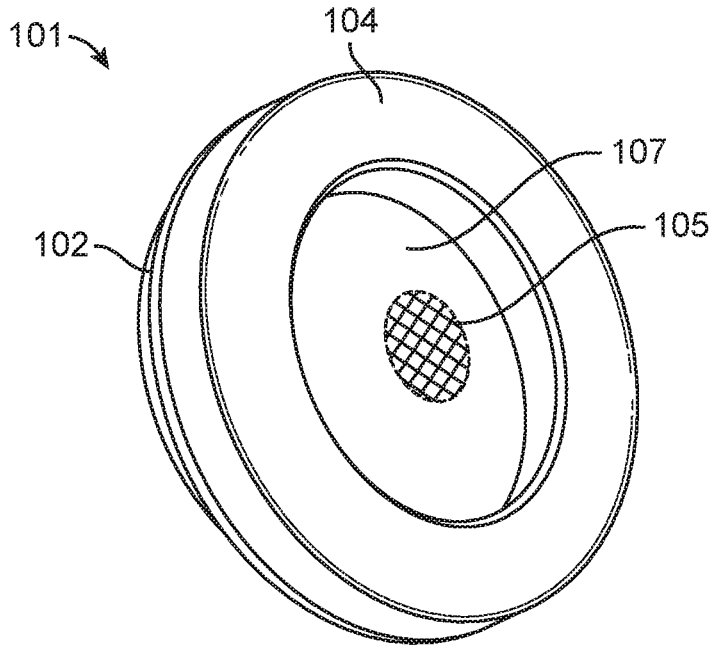
FIG. 1B shows a front perspective view of an earcup assembly of FIG. 1A.

With reference to FIGS. 1A-1B, an example closed-back, over-ear headphone 100 and an earcup assembly 101 are illustrated, respectively. Earcup assemblies 101 (identified individually as a first earcup assembly 101A and a second earcup assembly 101B) are attached to opposing ends of a headband 103 of headphone 100. Each earcup assembly 101 includes an earcup 102 (e.g., shell, housing) and an earcup cushion 104 (e.g., earpad) extending around an entire periphery of earcup 102. Each earcup assembly 101 further includes a speaker 105 (e.g., driver, acoustical transducer) configured to produce sound waves. Earcup 102 can include one or more components assembled together (e.g., a housing plate, a back shell or housing, an earcup cushion holder). The speaker 105 can be positioned within or at least partially inside earcup 102. For example, in some embodiments, speaker 105 is supported within earcup 102 by a driver housing plate 107 (e.g., grille, frame, cover) or other support.

Figure 2:
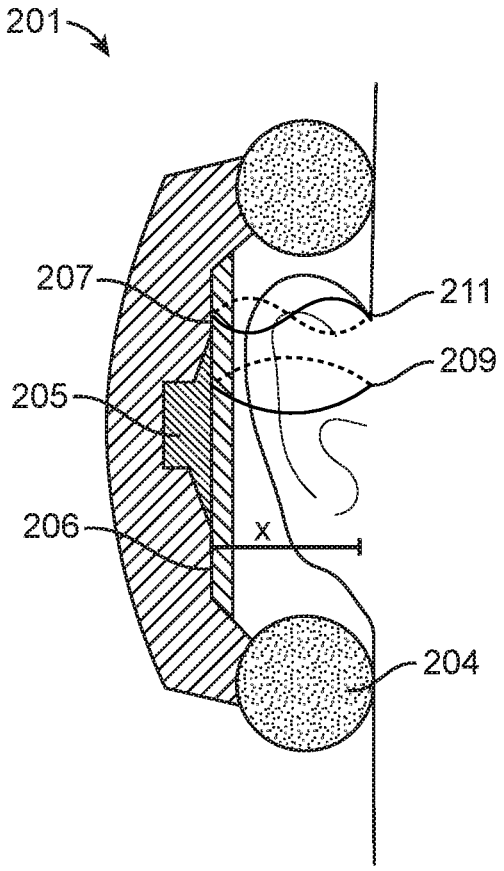
FIG. 2 shows a cross-sectional view of a conventional dampening material positioned on a front surface of a driver housing plate of an over-ear headphone earcup assembly.

As noted above, standing waves (e.g., in about a 7-9 kHz range) can develop inside an earcup (e.g., a front volume) of closed-back, over-ear headphones between a driver housing plate and a user's skull as a result of the sound isolating design of closed-back, over-ear headphones when in-use. Such standing waves (e.g., traveling along a horizontal or lateral axis) can create a strong resonance in a frequency response of a headphone. As illustrated in FIG. 2, a conventional earcup assembly 201 is provided with a layer of sound absorbing material 206 on a driver housing plate 207. Typically, standing waves have frequencies f governed by the following equation:

$$f=(n*c)/(2*x) \quad \text{(Equation 1)}$$

Where x is the distance between resonating plates (e.g., driver housing plate and user's skull and/or ear), c is the sound velocity, and n is the nth order of the standing wave. First order and second order waves 209 and 211 are illustrated in FIG. 2.

Typically, in order to provide sufficient dampening, such sound absorbing material 206 would have to be in a thickness range of about 5% to 10% of a wavelength of the standing waves. Sound absorbing material having such a thickness range may require relatively large earcups to accommodate the material. In context of headphones where minimizing or reducing size (e.g., slim headphone design) is important for performance, portability, comfort, or aesthetics, this may be impractical. Therefore, there remains a need for headphones with improved dampening features, and in particular tunable dampeners tuned to dampen such standing wave resonances.

Figure 3:
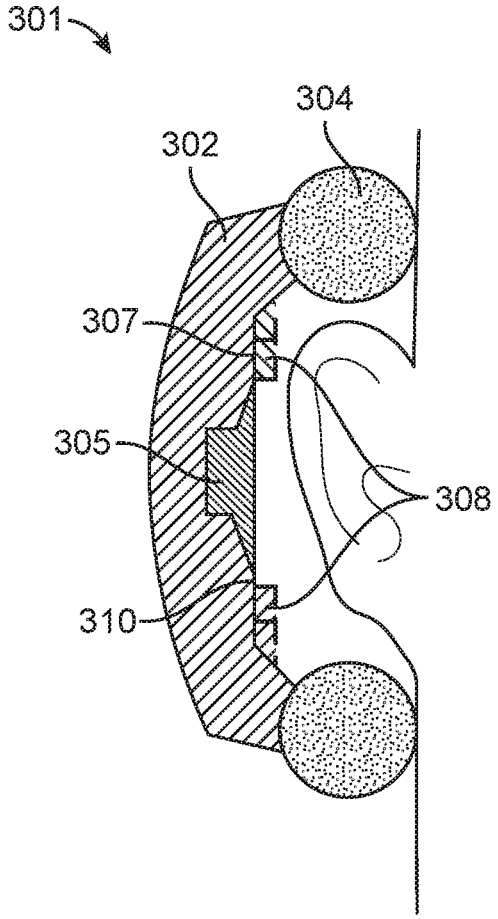
FIG. 3 shows a cross-sectional view of an over-ear headphone earcup assembly with tunable dampeners configured in accordance with an embodiment of the present disclosure.

With reference to FIG. 3, an earcup assembly 301 is shown that is configured in accordance with embodiments of the present disclosure. Earcup assembly 301 can be used with closed-back, over-ear headphones (e.g., headphone 100) and replaces conventional earcup assemblies (e.g., earcup assembly 201). It should be understood that the Figure illustrates only one of a pair of left and right ear earcup assemblies of a headphone. Thus, each of the features described in reference to earcup assembly 301 illustrated in FIG. 3 should be understood as applying to the other earcup assembly.

Earcup assembly 301 includes one or more same or similar features, in whole or in part, as earcup assembly 101. For example, earcup assembly includes an earcup 302 and an earcup cushion 304 extending around an entire periphery of earcup 302. Earcup assembly 301 includes a speaker 305 configured to produce sound waves. Speaker 305 can be positioned within or at least partially inside earcup 302. In some embodiments, speaker 305 is supported within earcup 302 by a driver housing plate 307 or other suitable support.

Earcup assembly 301 further includes a plurality of passive, tunable acoustic dampeners 308 positioned on a front surface 310 of driver housing plate 307. In other embodiments, tunable dampeners 308 are positioned on a portion of a driver module in addition to or instead of drive housing plate 307. For example, tunable dampeners 308 can be positioned on a driver module lip or frame (e.g., extending around a periphery of a speaker diaphragm). Generally, tunable dampeners 308 are positioned around or spaced apart from diaphragms of such speakers to minimize interference with sound produced by the speakers, and in some embodiments, tunable dampeners 308 fully surround speaker 305.

Tunable dampeners 308 can be tuned (e.g., configured) to dampen (e.g., match, absorb) standing wave frequencies (e.g., in about a 7-9 kHz range). For example, in some embodiments dampeners 308 are resonators with resonance frequencies that can be tuned to dampen resonance frequencies of standing waves. In other embodiments, dampeners 308 include a dampening or sound absorbing material 306 configured to absorb such standing wave frequencies as such waves move or reflect through material 306. Further, in some embodiments, tunable dampeners 308 can absorb or be tuned to dampen a single standing wave frequency. However, in other embodiments, tunable dampeners 308 can absorb or be tuned to dampen various or different standing wave frequencies such that a range of standing waves (e.g., more than one frequency) can be dampened. Further details of tunable dampeners 308 are illustrated and described below with respect to FIGS. 4A-6B.

Figure 4A:
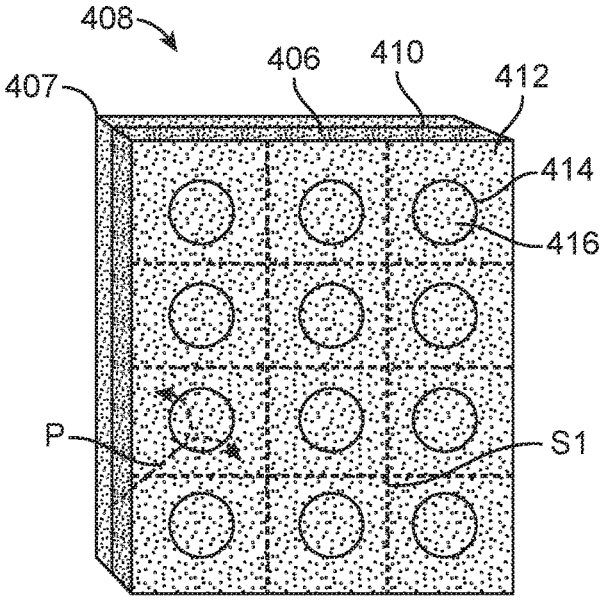
FIGS. 4A-4B show top and side views, respectively, of a portion of tunable dampeners configured in accordance with an embodiment of the present disclosure.
Figure 4B:
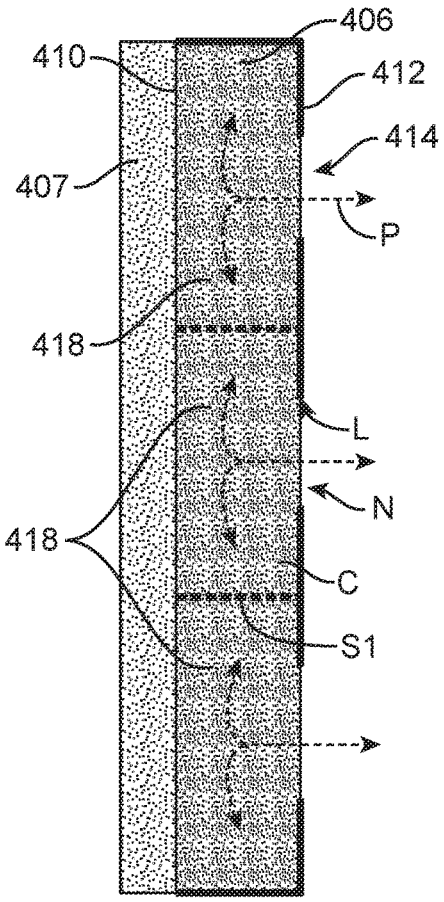

FIGS. 4A-4B, 5A-5B, and 6A-6B illustrate various dampening features and configurations that can be provided with tunable dampeners 308 of earcup assembly 301 in accordance with embodiments of the present disclosure. For example, FIGS. 4A-4B illustrate a plurality of tunable dampeners 408 with a solid film layer 412 (e.g., sheet, cover, liner) positioned over a sound absorbing material 406 (e.g., foam, wool, or other suitable porous dampening material). Solid film layer 412 includes a plurality of openings 414 (e.g., perforations) such that portions 416 of absorbing material 406 underneath solid film layer 412 are uncovered or exposed via such openings 414. While illustrated as having circular openings 414, in other embodiments, layer 412 can include other suitably shaped openings. For example, rectangular openings are shown with respect to tunable dampeners 608 described in more detail below with respect to FIGS. 6A-6B.

Openings 414 lead into a plurality of chambers 418 of absorbing material 406. Further, front surface of 410 of driver housing plate 407 forms a back side or surface of each chamber 418. In some embodiments, a buffer or intermediary layer is positioned between front surface 410 and back surfaces of chambers 418 (e.g., back surface of absorbing material 406). Front surface 410 or an intermediary layer can seal a back side of chambers 418.

Unwanted or undesirable sound waves (e.g., standing wave resonances) enter chambers 418 through openings 414 and are dampened (e.g., energy is absorbed) as such waves move or reflect through absorbing material 406. In conventional absorbing materials, standing waves generally can enter, move or reflect, and exit such materials along paths substantially parallel to each other. In contrast, sound waves (e.g., standing waves) enter, move or reflect, and exit through chambers 418 along substantially non-parallel paths (e.g., identified with arrows and broken lines P). For example, sound waves can enter chambers 418 along a first direction (e.g., parallel to a lateral axis) and then reflect or travel through chambers in second and/or third directions non-parallel (e.g., transverse, perpendicular, oblique) to the first direction. As such, a distance or path of standing waves moving or reflecting through chambers 418 is increased relative to absorbing materials without a plurality of openings and chambers. This effectively increases a thickness of sound absorbing material 406 relative to a conventional layer of sound absorbing material where sound waves simply enter, move or reflect, and exit through a thickness of the absorbing material. Where as in the present embodiments, sound waves can enter each chamber via openings and travel through a thickness of the chambers but also in multiple directions (e.g., up or down through each chamber) before reflecting back or exiting, effectively increasing paths of the sound waves through the chambers. Effectively increasing a thickness of sound absorbing material 406 by providing a plurality of chambers 418 and/or increasing a path standing waves move or reflect through (e.g., along a non-conventional path), rather than just increasing a thickness of a layer of conventional absorbing material (e.g., thickness of material 206), allows for dampening of standing wave resonances while also maintaining a relatively thin or compact headphone design.

Figure 5A:
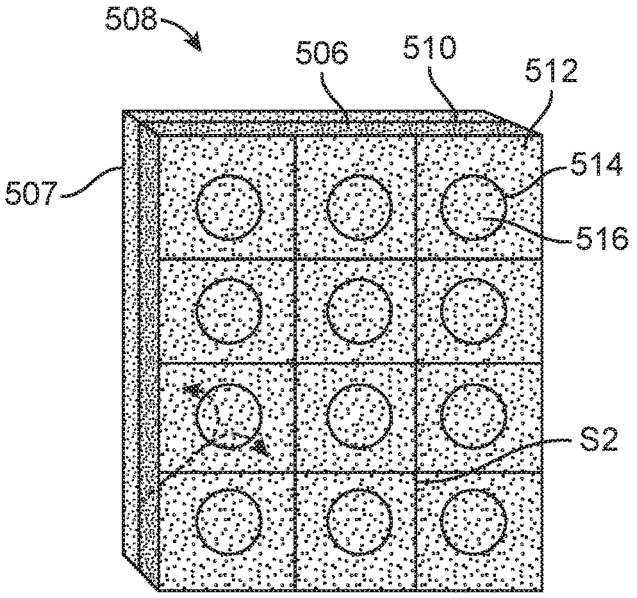
FIGS. 5A-5B show top and side views, respectively, of the tunable dampeners of FIGS. 4A-4B with sidewalls in accordance with another embodiment of the present disclosure.
Figure 5B:
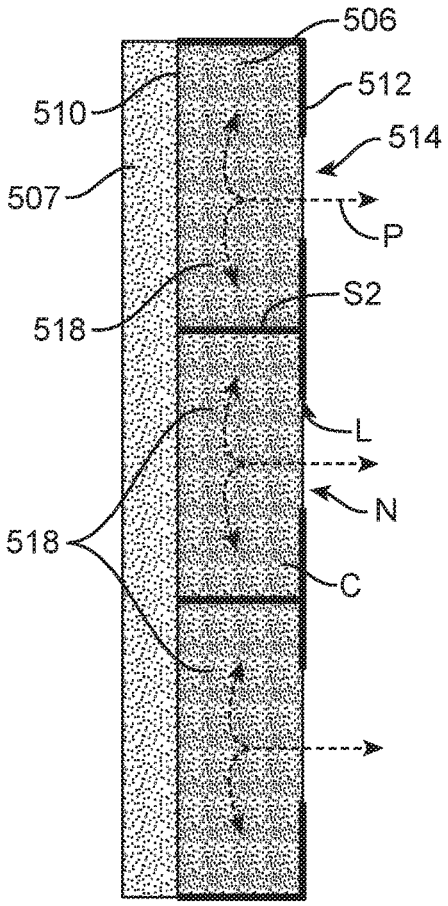

Chambers 418 are illustrated with "virtual" sidewalls (e.g., identified in broken lines S1). Such sidewalls S are referred to herein as virtual because there are no actual sidewalls or surfaces extending between front housing plate 410 and layer 412. The plurality of openings 414 allow standing waves to enter chambers 418 and move or reflect as described above. In other embodiments, sidewalls can be included. Dampeners 508 of FIGS. 5A-5B are similarly configured as dampeners 408 of FIGS. 4A-4B. However, dampeners 508 include actual sidewalls (e.g., dividers identified in solid lines S2) extending between front housing plate 510 or other solid buffer/intermediary layer and solid film layer 512.

While illustrated as being filled with sound absorbing material (e.g., material 406 or 506), in other embodiments, dampeners 408 or 508 can be provided without such material. As a result, openings 414, 514 and chambers 418, 518 form a plurality of acoustic resonators (e.g., cavities or hollow spaces). Acoustic resonators can be tuned to a resonance frequency which matches unwanted standing wave frequencies (e.g., to absorb undesirable sounds at their resonance frequencies). In particular, dampeners 408 or 508 can be a plurality of Helmholtz resonators. Generally, a Helmholtz resonator includes a neck portion N that leads into a larger cavity C. Resonance frequency of a Helmholtz resonator depends on a cross-sectional area A and length L of the neck portion N, a volume V of the cavity C, and speed of sound c, according to the following equation:

$$f = \frac{c}{2\pi}\sqrt{\frac{A}{VL}} \qquad \text{(Equation 2)}$$

Therefore, dimensions of neck portion or cavity can be optimized as desired such that dampeners 408 or 508 are tuned to a desired resonance frequency or frequencies to dampen or absorb unwanted standing wave frequencies. For example, a size of cavity C can be increased for each dampener to absorb lower frequencies.

Figure 6A:
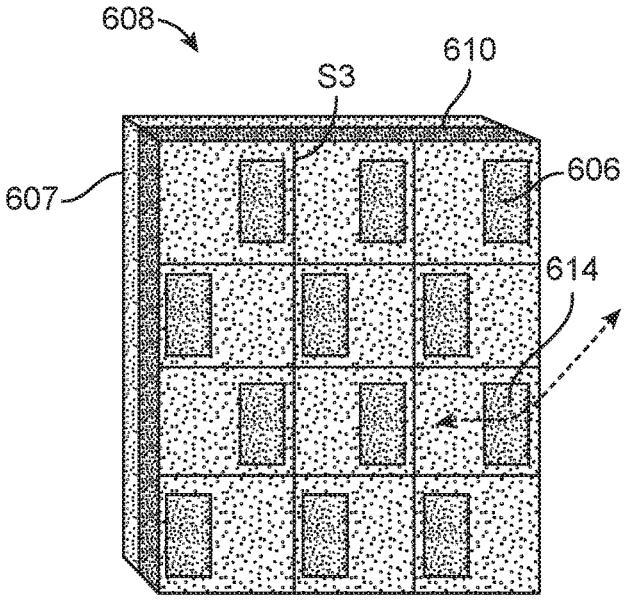
FIGS. 6A-6B show top and side views, respectively, of a portion of tunable dampeners configured in accordance with another embodiment of the present disclosure.
Figure 6B:
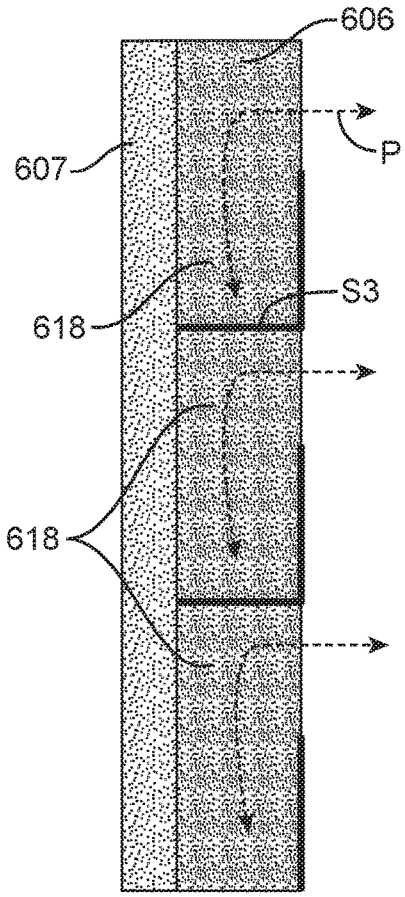

FIGS. 6A-6B illustrate a plurality of dampeners 608 configured in accordance with another embodiment of the present disclosure. Such dampeners 608 include a plurality of rectangular openings 614 in solid film layer 612. Openings 614 can be offset or positioned off-center from a midline of a corresponding chamber 618. While illustrated with actual sidewalls S3, similar to dampeners 408 and 508, dampeners 608 can include virtual sidewalls. As illustrated, unwanted standing waves can enter via openings 614 and follow a generally L-shaped path through dampening sound material 606 within each chamber 618. As with dampeners 408 and 608, this effectively increases a thickness of sound absorbing material 606 by providing a plurality of chambers 618 standing waves can be absorbed or dampened in. Further, a path of such standing waves is increased (e.g., along the L-shaped path P) relative to waves moving and reflecting back through a conventional layer of absorbing material. In other embodiments, dampeners 608 can include hollow chambers 618 without absorbing material 606 to form resonators tuned to dampen standing waves as described above with respect to dampeners 408 and 508.

Figure 7:
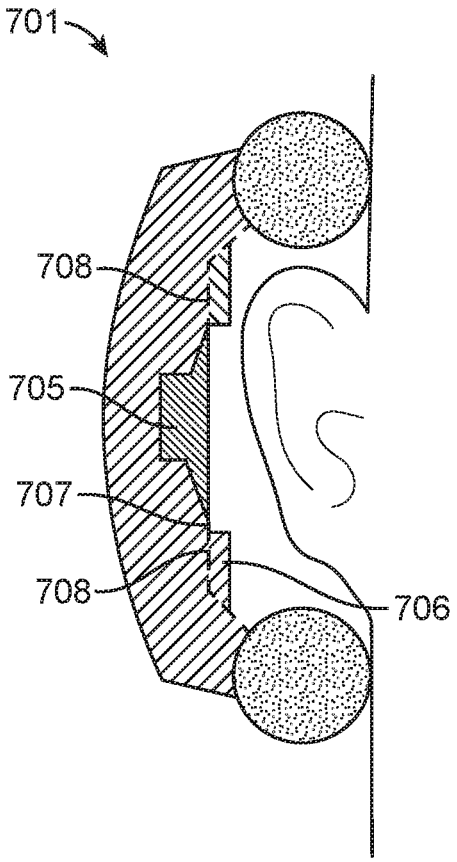
FIG. 7 shows a cross-sectional view of an over-ear headphone earcup assembly with tunable dampeners configured in accordance with another embodiment of the present disclosure.

With reference to FIG. 7, earcup assembly 701 is shown that is configured in accordance with other embodiments of the present disclosure. Earcup assembly 701 can be used with closed-back, over-ear headphones (e.g., headphone 100) and replaces conventional earcup assemblies (e.g., earcup assembly 201). It should be understood that the Figure illustrates only one of a pair of left and right ear earcup assemblies of a headphone. Thus, each of the features described in reference to earcup assembly 701 illustrated in FIG. 7 should be understood as applying to the other earcup assembly.

Earcup assembly 701 includes one or more same or similar features, in whole or in part, as earcup assembly 301. For example, earcup assembly 701 includes a plurality of passive, tunable acoustic dampeners 708. Dampeners 708 can be tuned (e.g., configured) to dampen (e.g., match, absorb) standing wave frequencies (e.g., in about a 7-9 kHz range). In some embodiments dampeners 708 are resonators with resonance frequencies that can be tuned to dampen resonance frequencies of standing waves. In other embodiments, dampeners 708 include a dampening or sound absorbing material 706 configured to absorb such standing wave frequencies as such waves move or reflect through material 706. Further, in some embodiments, tunable dampeners 708 can absorb or be tuned to dampen a single standing wave frequency. However, in other embodiments, tunable dampeners 708 can absorb or be tuned to dampen various or different standing wave frequencies such that a range of standing waves (e.g., more than one frequency) can be dampened.

Rather than being positioned on or over a speaker housing plate or driver module, acoustic dampeners 708 are integrated or formed within driver housing plate 707 and/or in a driver module. For example, such dampeners 708 include holes or cavities drilled, cut, or otherwise machined into or through housing plate 707. In such embodiments, a thickness of housing plate 707 or a driver module can be utilized for dampening unwanted resonance frequencies without substantially reducing product stiffness (e.g., of earcup assembly 701). Generally, tunable dampeners 708 are positioned around or spaced apart from diaphragms of speakers or drivers to minimize interference with sound produced by such speakers. Further details of tunable dampeners 708 are illustrated and described below with respect to FIGS. 8A-10B.

Figure 8A:
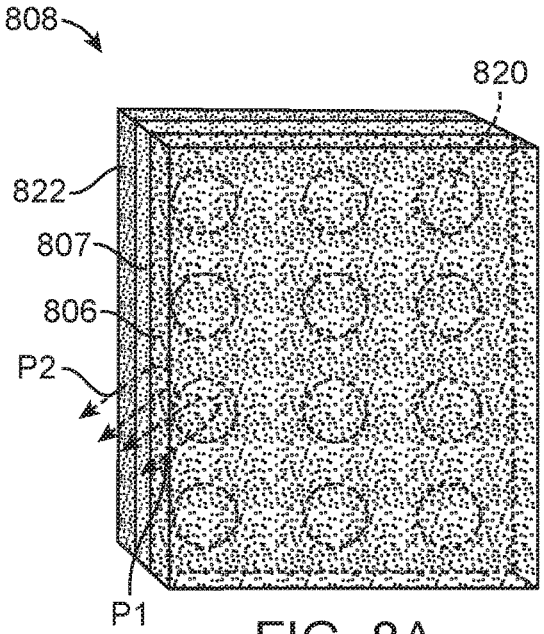
FIGS. 8A-8B show top and side views, respectively, of a portion of tunable dampeners configured in accordance with another embodiment of the present disclosure.
Figure 8B:
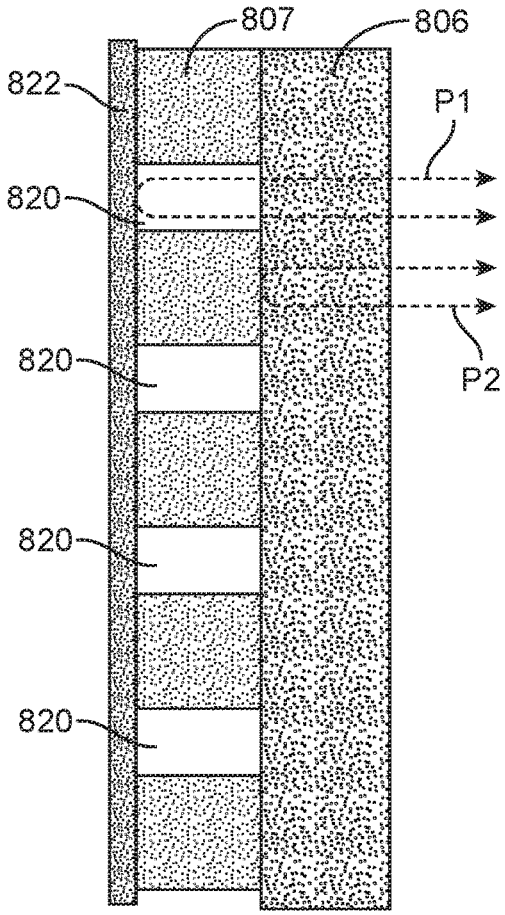
Figure 9A:
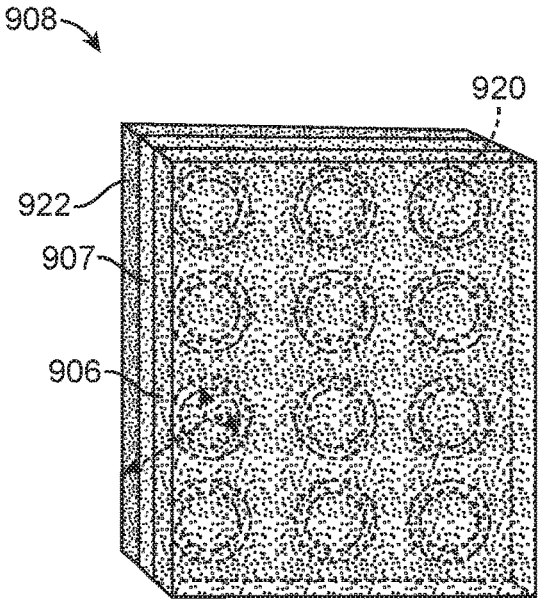
FIGS. 9A-9B show top and side views, respectively, of a portion of tunable dampeners configured in accordance with another embodiment of the present disclosure.
Figure 9B:
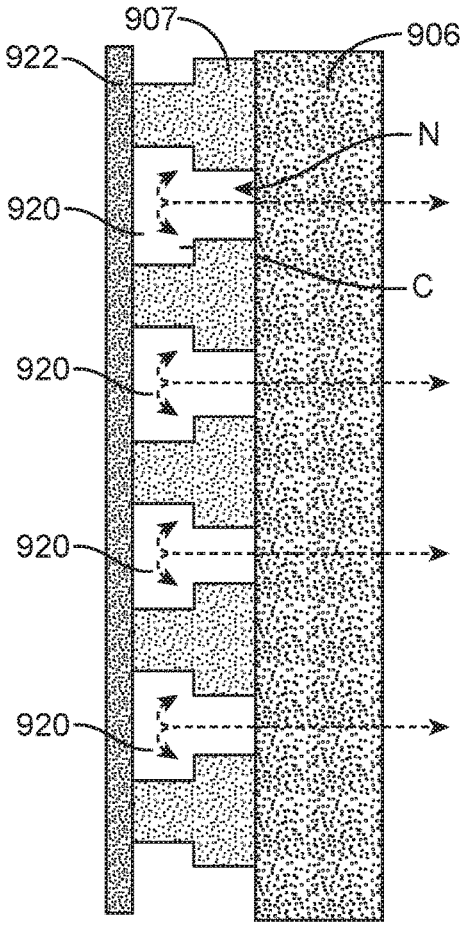
Figure 10A:
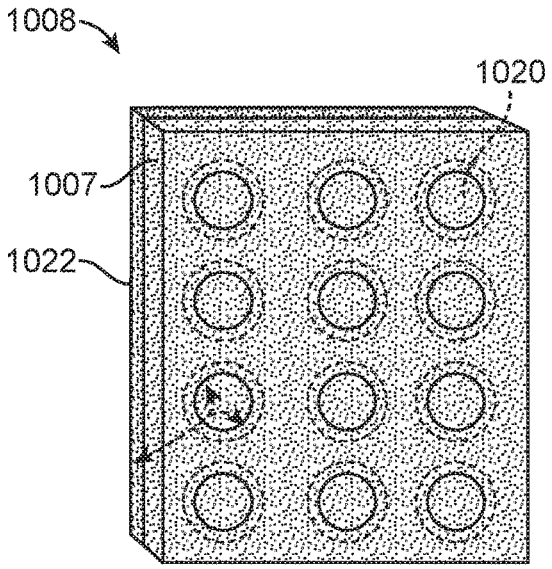
FIGS. 10A-10B show top and side views, respectively, of a portion of tunable dampeners configured in accordance with another embodiment of the present disclosure.
Figure 10B:
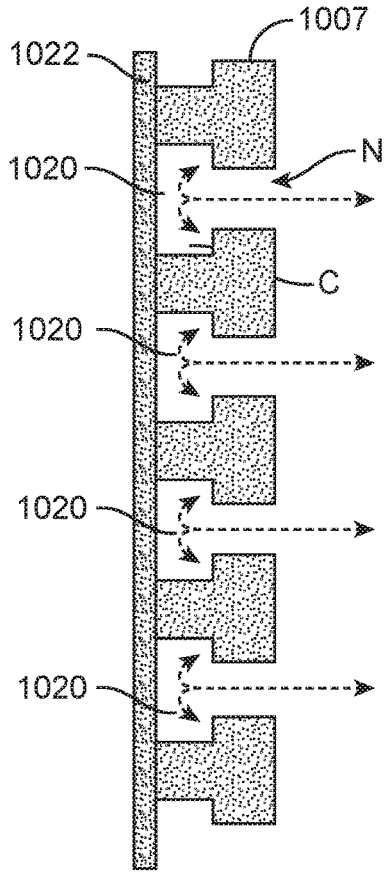

FIGS. 8A-8B, 9A-9B, and 10A-10B illustrate various dampening features and configurations that can be provided with tunable dampeners 708 of earcup assembly 701 in accordance with embodiments of the present disclosure. For example, FIGS. 8A-8B illustrate dampeners 808 with a plurality of holes or cavities 820 drilled, cut, or otherwise machined into or through housing plate 807. In other embodiments, cavities 820 are formed in a driver module frame instead of or in addition to housing plate 807. A back plate 822 or other layer extends along a back side of housing plate 807 to seal a first end of cavities 820. A layer of sound absorbing material 806 extends along a front side of housing plate 807 and a second end of cavities 820. While illustrated without a sound absorbing material 806 within cavities 820, in other embodiments, such cavities 820 can also be filled with sound absorbing material (e.g., material 806 or a different material).

Integrating or forming acoustic dampeners 808 within driver housing plate 807 or in a driver module, effectively increases a path of standing waves reflecting or moving between housing plate and a user's skull. A path (e.g., identified as P1) extends into and through housing plate 807 such that standing waves reflect off back plate 822 at first end of cavities 820 rather than absorbing material at second end of cavities 820. As described above with other embodiments, increasing this path and providing a plurality of cavities 820 or chambers provides dampening of standing wave resonances without having to increase a thickness of absorbing material 806 (e.g., allowing a more compact or thin headphone design). However, material 806 extending along a front side of housing plate 807 can provide conventional dampening (e.g., as illustrated by a path P2 of waves reflected off a front surface of housing plate 807), for example, higher frequency resonance. In other embodiments, dampeners 808 do not include a conventional absorbing material 806 extending along front side of housing plate 807. Further, cavities 820 of dampeners 808 can be configured as acoustic resonators (e.g., a tube with a closed end and open end) and tuned to dampen standing wave resonance(s). Further, cavities 820 can have circular, rectangular, or other suitable cross-sections.

FIGS. 9A-9B and 10A-10B show dampeners 908 and 1008, respectively. Dampeners 908 and 1008 are configured similarly to dampeners 808 and include one or more identical features, in whole or in part as dampeners 808. Dampeners 908 and 1008 each include cavities (e.g., cavities 920 and 1020) configured or shaped as Helmholtz resonators (e.g., include a neck portion N leading into a cavity portion C). A first end of cavities 920 and 1020 are sealed with back plate 922, 1022 or other layer. Additionally, dampeners 908, include a layer of sound absorbing material 906 (e.g., to provide conventional dampening) extending along a front side of housing plate 907 and a second end of cavities 920.

In contrast to dampeners 908, dampeners 1008 do not include a layer of sound absorbing material extending along a front side of housing plate 1007 and a second end of cavities 1020. As described above with respect to cavities 820, cavities 920 and 1020 can also include absorbing material (e.g., absorbing material 906 or a different type of absorbing material) within each cavity accordingly. Dampeners 908 and 1008 can have resonance frequencies tuned (e.g., according to equation 2) to dampen standing wave resonances. As described above with respect to other embodiments, dampeners 908 and 1008 can be tuned to dampen a single resonance frequency or various different frequencies.

Figure 11A:
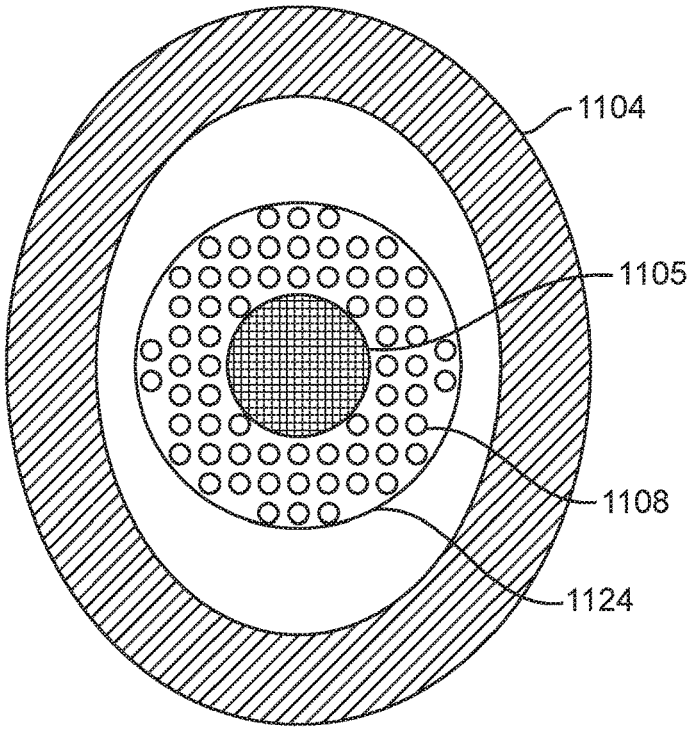
FIGS. 11A-11B show cross-sectional views of over-ear headphone earcup assemblies with tunable dampeners configured in accordance with various embodiments of the present disclosure.
Figure 11B:
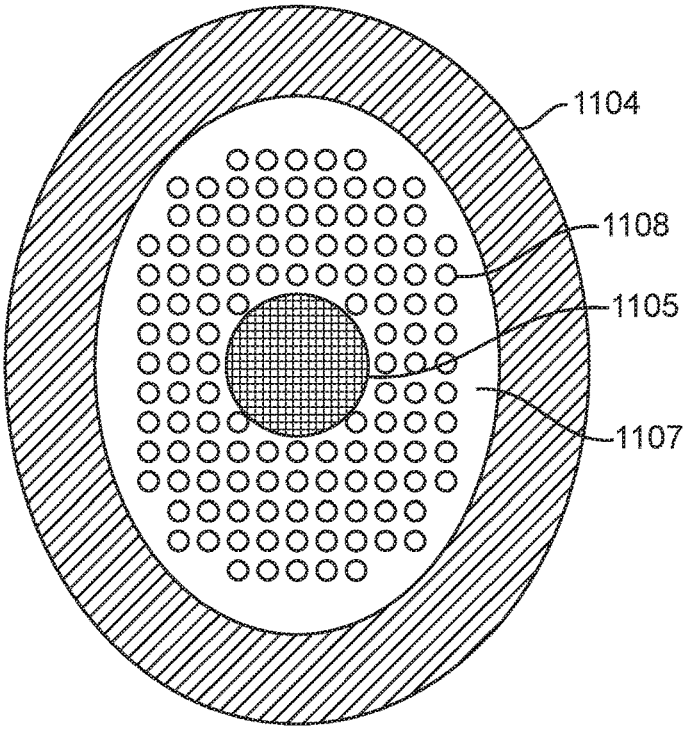

As illustrated in FIGS. 11A-11B and described above, each of the embodiments of dampeners 1108 (e.g., 308 and 708) can be positioned on a front surface 1110 of driver housing plate 1107 (e.g., as a dampeners on top of the front housing plate or integrated into the housing plate). In some embodiments, tunable dampeners 1108 are positioned on or integrated into a portion of a driver module 1124 in addition to or instead of drive housing plate 1107. Further, in each of the embodiments of tunable dampeners discussed above, the dampeners can be arranged in an array or matrix-like pattern around a periphery of the speaker 1105 as illustrated.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

References throughout the foregoing description to features, advantages, or similar language do not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the present invention may be combined in any suitable manner in one or more embodiments. One skilled in the relevant art will recognize that the present invention can be practiced without one or more of the specific features or advantages of a particular embodiment. In other instances, additional features and advantages may be recognized in certain embodiments that may not be present in all embodiments of the present invention.

Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

What is claimed is:

1. A headphone comprising: a first earcup assembly including a first speaker, a plurality of acoustic dampeners at least partially surrounding the first speaker and a front volume housing extending along a back side of the plurality of acoustic dampeners, the plurality of acoustic dampeners being configured to dampen standing wave resonances at one or more frequencies in a range of 7 to 9 kHz and wherein the plurality of acoustic dampeners includes a plurality of chambers bounded by the front volume housing and a solid film layer having a plurality of openings corresponding to the plurality of chambers, wherein each opening in the plurality of openings is arranged to allow standing waves to enter one of the plurality of chambers; a second earcup assembly; and a headband extending between the first and second earcup assemblies, the headband including first and second opposing ends attached to the first and second earcup assemblies, respectively, wherein the plurality of acoustic dampeners comprise a layer of sound absorbing material and a solid film layer positioned over the layer of sound absorbing material, the solid film layer including a plurality of openings formed therethrough exposing the sound absorbing material.

2. The headphone of claim 1, wherein each of the plurality of chambers and its corresponding opening is configured such that standing waves enter the chamber in a first direction and travel therethrough in a second direction, the second direction being non-parallel to the first direction.

3. The headphone of claim 2, wherein each of the plurality of chambers and its corresponding opening is configured such that the standing waves travel along a substantially L-shaped path through the plurality of chambers.

4. The headphone of claim 3, wherein the plurality of chambers comprises a plurality of sidewalls extending substantially transverse to the front side of the solid film layer.

5. The headphone of claim 4, wherein the plurality of chambers comprises an acoustic dampening material positioned with each chamber.

6. The headphone of claim 1, wherein the plurality of acoustic dampeners is tuned to dampen standing waves of a same frequency.

7. The headphone of claim 1, wherein a first acoustic dampener of the plurality of acoustic dampeners is tuned to dampen a standing wave of a first frequency and a second acoustic dampener of the plurality of acoustic dampeners is tuned to dampen a standing wave of a second frequency, and wherein the first frequency is different from the second frequency.

8. The headphone of claim 1, wherein the plurality of acoustic dampeners comprises a plurality of acoustic resonators.

9. The headphone of claim 8, wherein the plurality of acoustic resonators comprises a plurality of Helmholtz resonators.

10. The headphone of claim 1 wherein the first earcup assembly comprises a front volume housing and wherein the front volume housing comprises at least one of a speaker grill and speaker module.

11. The headphone of claim 1, wherein the second earcup assembly includes a second speaker and a plurality of acoustic dampeners at least partially surrounding the second speaker, the plurality of acoustic dampeners being configured to dampen standing wave resonances.

12. The headphone of claim 1, wherein the plurality of acoustic dampeners encircle a periphery of the first speaker.

13. The headphone of claim 1, wherein the plurality of acoustic dampeners encircle a periphery of the second speaker.

14. An over-ear headphone comprising: a headband including first and second opposing ends; a first ear cup assembly coupled to the first end of the headband; a second ear cup assembly coupled to the second end of the headband; wherein each of the first and second ear cup assemblies comprise: an ear cup; an ear cup cushion extending around a periphery of the ear cup; a speaker positioned within the ear cup; and a plurality of acoustic dampeners positioned within a front volume of the ear cup assembly and arranged to at least partially surround a periphery of the speaker, wherein the plurality of acoustic dampeners comprise a layer of sound absorbing material and a solid film layer positioned over the layer of sound absorbing material, the solid film layer including a plurality of openings formed therethrough exposing the sound absorbing material.

15. The over-ear headphone of claim 14 wherein, in each of the first and second ear cup assemblies: the ear cup includes a driver housing plate; the speaker is coupled to the driver housing plate; and the plurality of acoustic dampeners are coupled to a front surface of the driver housing plate such that the solid film layer is positioned over the driver housing plate.

16. The over-ear headphone of claim 15 wherein the plurality of acoustic dampeners includes a plurality of chambers bounded on a first side by the front surface of the driver housing plate and bounded by a second side, opposite the first side by the solid film layer, and wherein each opening in the plurality of openings defines a chamber in the plurality of chambers.

17. The over-ear headphone of claim 16 wherein the plurality of acoustic dampeners include physical sidewalls extending between the front housing plate and the solid film layer that separate individual chambers in the plurality of chambers from each other.

18. The over-ear headphone of claim 14 wherein the plurality of acoustic dampeners in each ear cup assembly is configured to dampen, within the front volume, standing wave resonances at one or more frequencies in a range of 7 to 9 kHz.

19. An over-ear headphone comprising: a headband including first and second opposing ends; a first ear cup assembly coupled to the first end of the headband; a second ear cup assembly coupled to the second end of the headband; wherein each of the first and second ear cup assemblies comprise: an ear cup including a driver housing plate that includes a front surface that at least partially defines a front volume of its respective ear cup assembly; a back plate coupled to and extending along a back surface of the driver housing plate, opposite the front surface an ear cup cushion extending around a periphery of the ear cup; a speaker positioned within the ear cup; and a plurality of acoustic dampeners formed within the driver housing plate and arranged to at least partially surround a periphery of the speaker, wherein each acoustic dampener in the plurality of acoustic dampeners includes a cavity formed within the driving housing plate, the cavity being defined at least in part by the back plate and having an opening at the front surface of the driver housing plate opposite the back plate.

20. The over-ear headphone of claim 19 wherein in each of the first and second ear cup assemblies the plurality of acoustic dampeners includes a layer of sound absorbing material disposed over the front surface of the driver housing plate.

21. The over-ear headphone of claim 19 wherein each cavity in the plurality of acoustic dampeners includes a narrow neck portion at the opening at the front surface leading to a wider portion of the cavity that extends to the back plate.

22. The over-ear headphone of claim 21 wherein in each of the first and second ear cup assemblies the plurality of acoustic dampeners includes a layer of sound absorbing material disposed over the front surface of the driver housing plate.

23. The over-ear headphone of claim 19 wherein the plurality of acoustic dampeners in each ear cup assembly is configured to dampen, within the front volume, standing wave resonances at one or more frequencies in a range of 7 to 9 kHz.

* * * * *